US005771717A

United States Patent [19]

Broker et al.

[11] Patent Number: 5,771,717

[45] Date of Patent: Jun. 30, 1998

[54] SECURITY LOCK AND METHOD FOR LOCKING A LAUNDRY APPLIANCE

[75] Inventors: John F. Broker; Joel L. Herr; John E. Thomas, all of Newton; Evan R. Vande Haar, Pella, all of Iowa

[73] Assignee: Maytag Corporation, Newton, Iowa

[21] Appl. No.: 717,082

[22] Filed: Oct. 7, 1996

[51] Int. Cl.[6] ..... D06F 39/14

[52] U.S. Cl. ..... 68/12.26

[58] Field of Search ..... 68/12.26, 12.01, 68/12.02; 292/DIG. 69; 70/271, DIG. 30, 277, DIG. 41; 194/206, 207; 134/57 R

[56] References Cited

U.S. PATENT DOCUMENTS 4,999,763 3/1991 Ousborne ..... 134/57 R X 5,655,394 8/1997 DiRocco, Jr. ..... 68/12.26 X

*Primary Examiner*—Philip R. Coe

*Attorney, Agent, or Firm*—Zarley, McKee, Thomte, Voorhees, & Sease

[57] ABSTRACT

An improved laundry appliance is provided having a security system to control access to the clothes in the appliance. The security system includes a lock on the appliance for locking the appliance door in the closed position, and a control panel to actuate and deactuate the lock. The control panel includes a money payment receiver, such as a coin slot or a credit and debit card reader. The control panel also includes a security system such as a key, key card, or PIN access code, to prevent unauthorized deactuation of the lock.

20 Claims, 2 Drawing Sheets

SECURITY LOCK AND METHOD FOR LOCKING A LAUNDRY APPLIANCE

BACKGROUND OF THE INVENTION

Public laundry facilities are commonly used by many people for washing and drying articles of clothes, such as at apartments, laundromats, and dormitories. Oftentimes, a user leaves the facility while the washer and/or dryer is operating. The absence of the user from the facility presents the opportunity for theft of the clothes.

Therefore, a primary objective of the present invention is the provision of a security system for laundry appliances, including washers and dryers, to control access to the clothes in the appliance.

A further objective of the present invention is the provision of a method and means for engaging and disengaging a lock on a laundry appliance in response to input of a security code from the user.

Another objective of the present invention is the provision of an improved laundry appliance having a security lock to prevent the door of the appliance from being opened in the absence of the user.

Another objective of the present invention is the provision of a method of controlling access to clothes in a laundry appliance.

A further objective of the present invention is the provision of a security lock for a laundry appliance wherein the user can selectively lock the appliance to prevent theft of clothing therefrom.

Still another objective of the present invention is the provision of a lock on the laundry appliance which the user can actuate for a selected amount of time.

A further objective of the present invention is a method and means for controlling access to articles of clothing in a laundry appliance which is easy to use and secure in operation.

These and other objectives will become apparent from the following description of the invention.

SUMMARY OF THE INVENTION

The present invention is directed towards an improved laundry appliance, such as a machine for washing and drying articles of clothing, having laundry receiving space and a door movable between open and closed positions relative to the laundry receiving space. The improvement comprises a security lock on the appliance for locking the door in the closed position to prevent removal of clothes from the laundry receiving space by persons other than the user. The lock is moved between engaged and disengaged states in response to input of a security code from the user. The security code may be a key, key card, personal identification number, or other indicia associated with a particular user. A control panel on the appliance is operatively connected to sense the security code for engaging and disengaging the lock. Various alternative embodiments are contemplated for applying a financial cost to the use of the security lock, so that the lock is engageable for a predetermined time corresponding to the amount of payment from the user. The timed engagement of the lock can be overridden by inputting of the user's security code so the lock can be disengaged by the user. Upon expiration of the predetermined time, the lock will automatically disengage. The method of controlling access to the clothes in the laundry appliance includes the steps of entering a monetary value indicia into the control panel, such as a coin, a dollar bill, or the use of a credit or debit card. The lock is then engaged to prevent access into the laundry receiving space. The method also includes securing the actuated lock with indicia personalized to the user to prevent non-users from deactuating the lock. For example, such personalized indicia may be a key, a key card, the serial number of a dollar bill or ticket, or a personal identification number or security code either entered by the user on a keyboard or read from a debit or credit card.

DETAILED DESCRIPTION OF THE DRAWINGS

The present application is intended for use on clothes washing machines and clothes dryers in public laundry facilities, such as laundromats, apartments, and college and university dormitories.

Figure 1:
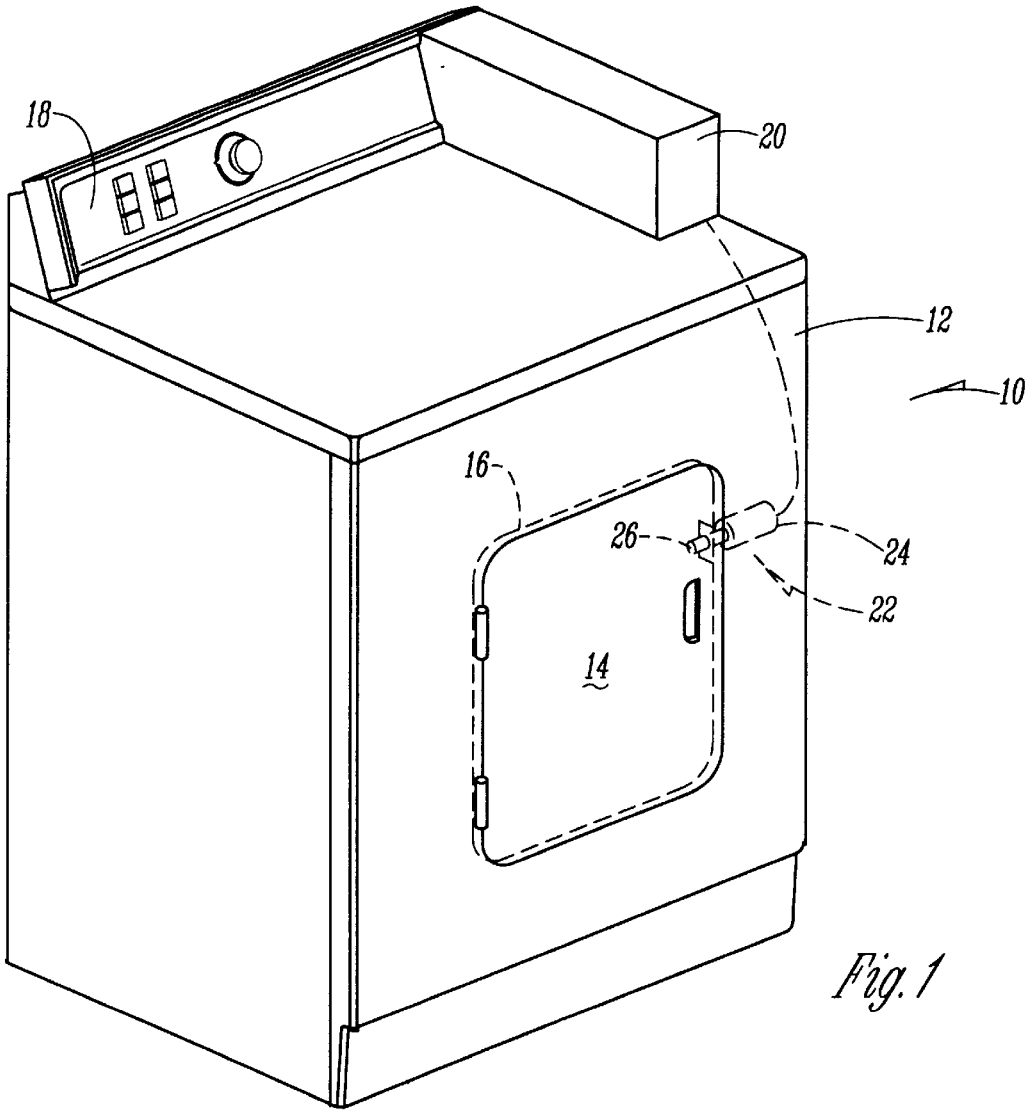
FIG. 1 is a perspective view of a laundry appliance having the security lock system of the present invention.

In FIG. 1, a laundry appliance, such as a machine for washing or drying articles, is generally designated by the reference numeral 10. While FIG. 1 depicts a horizontal axis appliance, it is contemplated that the present invention can also be utilized on a vertical axis appliance. The appliance includes a cabinet 12, a door 14 movable between open and closed positions with respect to an access opening 16, an internal chamber (not shown) for receiving laundry or other items to be washed or dried, and a control panel 18 for controlling the operation of the appliance 10.

The invention is directed towards an improvement to the appliance 10, that is, a security system for controlling access to the clothes in the appliance. The security system includes a control panel 20 and a lock mechanism 22. The lock mechanism 22 is engaged in response to a signal from the control panel 20 to secure the door in a closed position. In FIG. 1, one embodiment of the lock mechanism 22 is shown to be a solenoid 24 with an extendable and retractable piston 26. The solenoid is mounted inside the cabinet 12, and the piston 26 is adapted to retentively engage the door 14 when in the extended position, so as to prevent the door 14 from being opened. Concisely, when retracted, the lock mechanism 22 disengages from the door 14 permitting access to the laundry receiving space. Other types of lock mechanisms may also be used in conjunction with the control panel 20.

The control panel 20 includes a payment means for receiving payment from the user of the appliance. As seen in FIGS. 2–6, a coin slot 28 is provided for receiving a coin to pay for use of the appliance and the security system. A coin return slot 30 will return the coin to the user before actuation of the lock 22 when the coin return button 32 is depressed.

Figure 6:
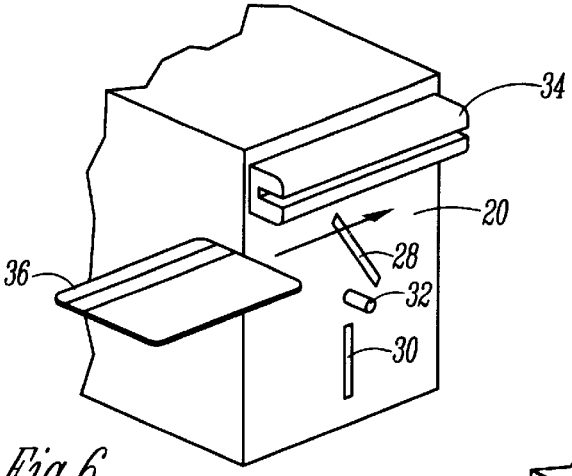
FIG. 6 is a partial sectional view showing the control panel with a credit or debit card reader for payment by the user.

In the embodiment shown in FIG. 6, a magnetic strip reader 34 is provided to read the magnetic strip 36 on a credit or debit card of the user, so as to charge the user for locking the appliance 10. Another alternative payment means is a store cash card 38, shown in FIG. 7, which may be purchased from the proprietor or attendant at the premises. The cash card 38 will allow the user a certain number of uses of the appliance and the security system, as registered by a card reader 40. A lock button 42 is provided to actuate the lock for the control panel shown in FIG. 7. The control panel 20 may also include circuitry to automatically release or disengage the lock after a specified amount of time, depending on the amount of money paid by the user.

The security system of the present invention includes a security code or personal identification for each individual user. The lock 22 is engaged and disengaged in response to a signal from the control panel 20. The signal is generated when the user inputs the personal security code.

Figure 2:
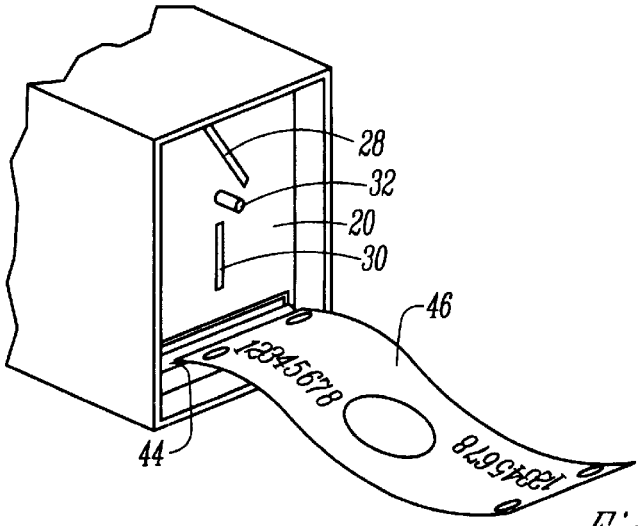
FIG. 2 is a partial perspective view of the control panel of the security system having a character reader for reading the serial number of a dollar bill.

For example, in FIG. 2, a character reader 44 is provided on the control panel 20 so as to read the serial number on a dollar bill 46 used by an individual user or other indicia on a ticket provided to the individual user by the proprietor. The user can thus input the bill or ticket and the control would engage the lock. Upon returning to the appliance, the user can insert the same bill or ticket and the control would recognize the input as identifying the authorized user. At that point, the control will disengage the lock to permit access to the laundry receiving space.

Figure 3:
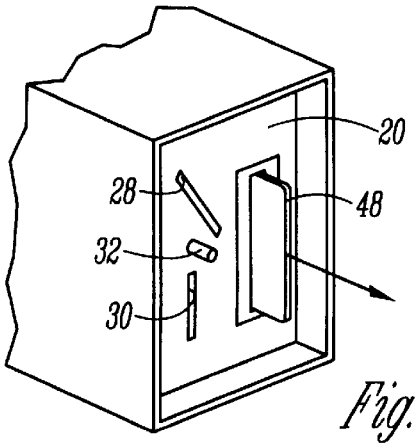
FIG. 3 is a partial perspective view of the control panel of the security system having a key card for securing the lock of the system.

Another embodiment of the security system is a key card 48, shown in FIG. 3, which can be removed after payment by the user so as to actuate the lock mechanism 22. Upon reinsertion by the user of the same key card 48 into the control panel, the lock mechanism 22 will be deactuated so that the user has access to the clothes in the appliance 10.

Figure 4:
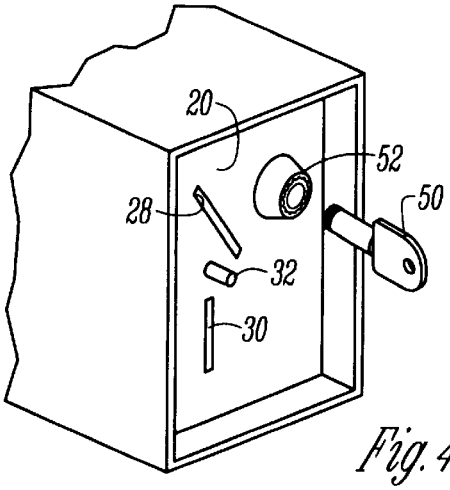
FIG. 4 is a partial perspective view of the control panel showing a key for securing the lock of the system.

Another embodiment of the security system is shown in FIG. 4. More particularly, a key 50 is provided which the user can use in a key hole 52 on the control panel 20 so as to lock and unlock the lock mechanism 22 after payment of the appropriate amount of money. Preferably, the lock 22 will not be actuated until the key 50 is removed from the key hole 52, and the key 50 cannot be removed until after payment is made by the user.

Figure 5:
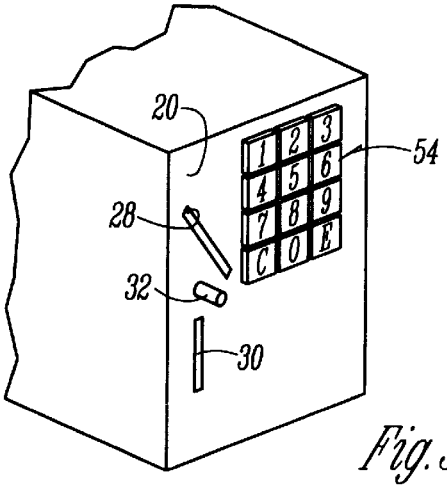
FIG. 5 is a partial perspective view showing a keyboard for entering the personal identification number of a user so as to secure the lock of the system.

In a further embodiment shown in FIG. 5, the security system includes a keyboard or keypad 54 such that each user can enter a personal identification number, as selected by the user. A first entry of the personal identification number actuates the lock mechanism 22, while a second entry of the personal identification number unlocks the locked mechanism 22. For example, a three digit PIN number is preferred. An entry button "E" is provided for entering the PIN number, while a clearance button (C) is provided to clear an incorrect number. This approach could also be accomplished using cycle selection buttons provided on the appliance in lieu of a separate keypad.

A still further embodiment is shown in FIG. 6 wherein a debit or credit card not only provides the necessary monetary unit for operation, but also has a security code stored on a magnetic strip 36. The magnetic strip reader 34 then reads the security code on the magnetic strip 36 to actuate the locking mechanism 22.

Figure 7:
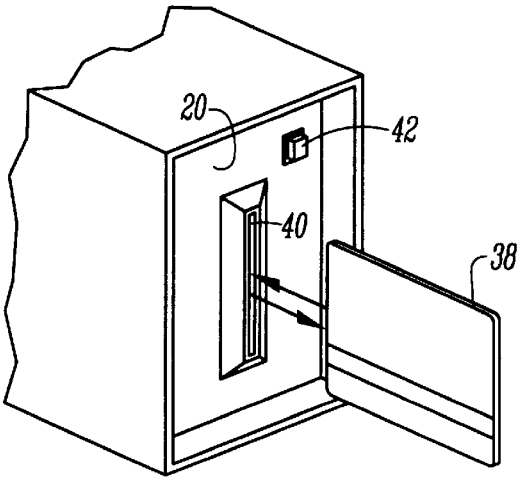
FIG. 7 is a partial perspective view of the control panel showing a cash card reader for payment by the user.

Similarly, the store cash card 38, shown in FIG. 7 may have a security code stored either on a magnetic strip or in a memory chip embedded in the card. The card reader 40 reads the security code on the cash card 38 to determine whether to lock or unlock the locking mechanism 22.

After engagement of the lock mechanism 22, the appliance 10 will remain inaccessible to other users or potential thieves until either the user unlocks the machine or expiration of a predetermined period of time after the end of the appliance operation lapses. A user may deposit an additional sum of money, beyond the cost of machine operation, at the start of operation to ensure the appliance will remain locked this predetermined amount of time. By adding more money at the onset, the appliance will remain locked a longer amount of time. If the user returns early, the entire money may be returned either via the coin return 30 or a debit card.

The security system of the present invention provides a method for controlling access to clothes in a laundry appliance, such as a clothes washer or dryer. The method includes the steps of supplying or entering payment such as money or a monetary equivalent, such as a credit or debit card, into the security system control panel 20 on the appliance 10. The lock mechanism 22 will automatically be actuated upon the monetary payment. Alternatively, the user may be required to press a button such as lock button 42 shown in FIG. 5, or remove a card such as card 48 shown in FIG. 3 to actuate the lock mechanism 22. The user may also secure the system to prevent unauthorized deactuation of the lock mechanism 22. Such security is provided through various means, such as the character or serial number reader 44 (FIG. 2), the key card 48 (FIG. 3), the key 50 (FIG. 4), or a PIN number entered via the keyboard 54 (FIG. 5).

While the invention has been shown and described in connection with the preferred embodiments thereof, it will be understood that many modifications, substitutions, and additions may be made which are within the intended broad scope of the following claims. For example, the cost of using the lock may be incorporated into the cost of using the appliance such that the appliance is always locked when operating. From the foregoing, it can be seen that the present invention accomplishes all of the stated objectives.

What is claimed is:

1. A laundry appliance comprising:

a machine for washing or drying articles placed within a laundry receiving space, a lock operable between engaged and disengaged states respectively to prevent and permit access to the laundry receiving space, a control for recognizing inputs identifying a particular user of the appliance, the control being capable of selectively engaging and disengaging the lock upon recognition of the input.

2. The laundry appliance of claim 1 further comprising:

a payment mechanism for receiving payment, the control operating the appliance in response to receiving the predetermined amount of payment, the control further engaging the lock in response to receiving the predetermined amount of payment.

3. The laundry appliance of claim 2 and wherein the payment mechanism includes a money receiver and a sensor for determining the value of the money.

4. The laundry appliance of claim 2 and wherein the payment mechanism includes a magnetic strip reader for reading a magnetic strip of a credit or debit card.

5. The laundry appliance of claim 1 further comprising:

a payment return mechanism for returning payment to the user upon receiving a signal from the control, the control further being capable of registering an initial amount of payment deposited and deducting an amount of payment corresponding to the amount of time the user left the lock engaged, and the control signaling the payment return mechanism to return an amount corresponding to the balance of the initial amount and the deducted amount.

6. The laundry appliance of claim 1 further comprising:

a keypad activation by the user, the keypad being connected to provide inputs to the control, the control recognizing inputs by a security code entered via the keypad by the user.

7. A method of selectively operating a lock for a laundry appliance comprising the steps of:

providing a user a security code input for a laundry appliance, providing a control capable of recognizing the security code, the control disengaging the lock of the laundry appliance in response to receiving the security code.

8. The method of claim 7 wherein the lock is actuatable upon payment of a monetary amount from the user.

9. The method of claim 8 wherein further comprising overriding the security code and disengaging the lock after an amount of time corresponding to the monetary payment from the user.

10. The method of claim 7 wherein the security code input is stored on a credit or debit card and the control is a card reader.

11. An improved laundry appliance having a chamber for holding clothes and a door movable between open and closed positions relative to the chamber, the improvement comprising:

a lock on the appliance for locking the door in the closed position to prevent removal of clothes from the chamber, a control panel operatively connected to the lock and adapted to engage and disengage the lock in response to input of a security code from a user.

12. The improved laundry appliance of claim 11 wherein the control panel includes a payment means for receiving payment from the user prior to enable actuation of the lock.

13. The improved laundry appliance of claim 12 wherein the payment means includes a money receiver and a sensor for determining the value of the money.

14. The improved laundry appliance of claim 12 wherein the payment means includes a magnetic strip reader for reading a magnetic strip of a credit or debit card.

15. The improved laundry appliance of claim 11 wherein the security code is a key.

16. The improved laundry appliance of claim 11 wherein the control panel includes a security system for inputting and recognizing the security code of the user.

17. The improved laundry appliance of claim 16 wherein the security system includes a character reader to read printed material from the user.

18. The improved laundry appliance of claim 16 wherein the security system includes a keyboard to enter a personal identification number of the user.

19. The improved laundry appliance of claim 11 wherein the security code is stored on a magnetic strip of a credit or debit card and the control panel includes a magnetic strip reader.

20. The improved laundry appliance of claim 11 wherein the security code is stored on a memory chip embedded in a credit, debit, or cash card and the control panel includes a card reader.

* * * * *